United States Patent [19]

Prince et al.

[11] 3,970,095

[45] July 20, 1976

[54] DISPOSABLE HAIR ROLLER

[76] Inventors: Zodell W. Prince, 8000 Bellaire Blvd., Houston, Tex. 77036; Dallas D. Weatherholt, 13207 Buxley, Houston, Tex. 77045; Adelene Trombatore Reistino, 1002 San Jose, Hearne, Tex. 77859

[22] Filed: Mar. 10, 1975

[21] Appl. No.: 556,957

[52] U.S. Cl. ..... 132/39

[51] Int. Cl.[2] ..... A45D 2/02

[58] Field of Search ..... 132/39, 40, 42, 41; 206/46 H; 260/27 R

[56] References Cited

UNITED STATES PATENTS

| | | | |
|---|---|---|---|
| 3,326,222 | 6/1967 | Rosenheim | 132/40 |
| 3,388,709 | 6/1968 | Morris | 132/42 |
| 3,791,391 | 2/1974 | Prince | 132/39 |

*Primary Examiner*—G.E. McNeill
*Attorney, Agent, or Firm*—Ranseler O. Wyatt

[57] ABSTRACT

A disposable hair roller formed of a flat sheet of pliable material that may be formed into a roll on which hair may be positioned for waving or setting purposes, the sheet having a plurality of perforations to provide a selective size of cylinder, and having buttons to be received by a selected row of said openings to maintain the sheet in a cylinder during use. A plurality of rollers may be formed from each sheet, perforations longitudinally formed in the sheet between each roller, providing means for breaking off each roller from the completed cylinder for individual use. When the hair is removed from the roller, the roller may be disposed of, or reused, if desired, so long as the buttons will be retained in the button receiving openings.

3 Claims, 4 Drawing Figures

Fig. 1
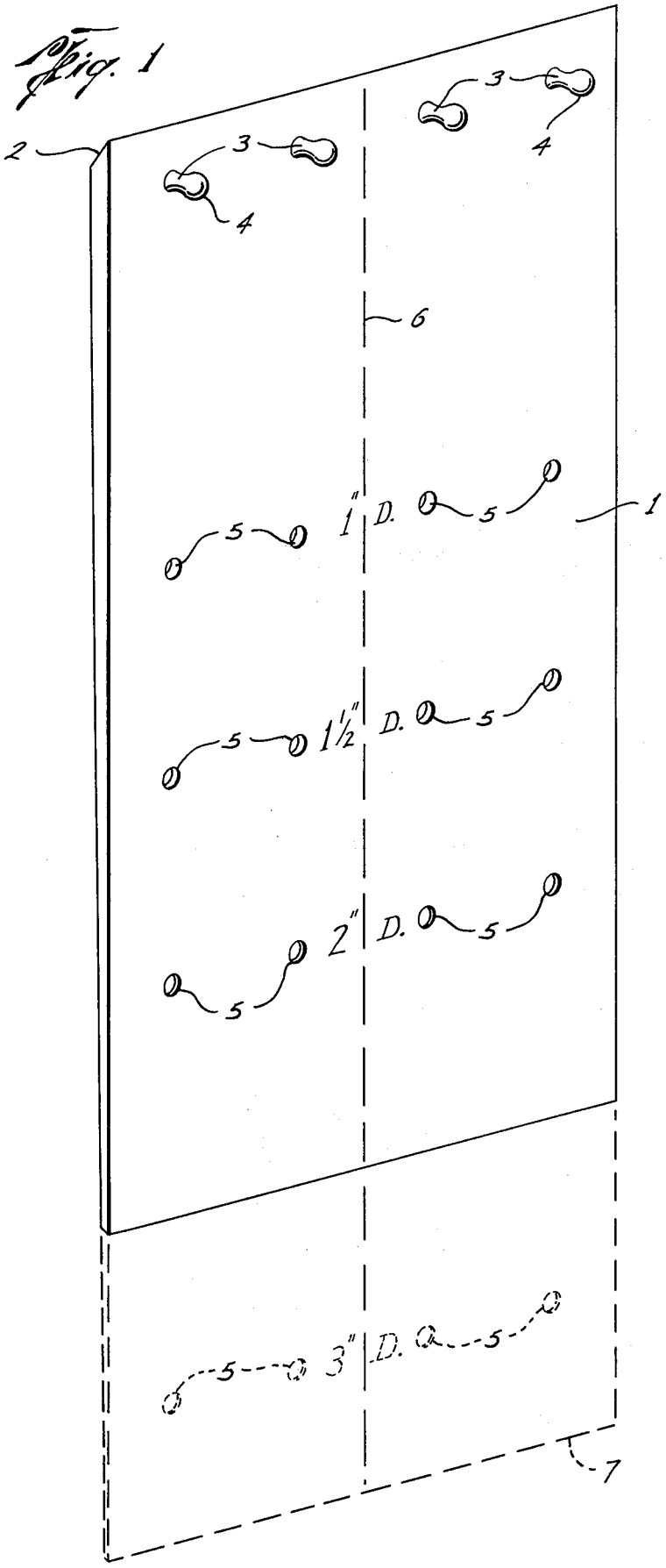
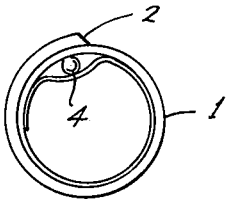
Fig. 2
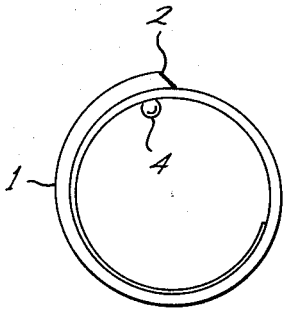
Fig. 3
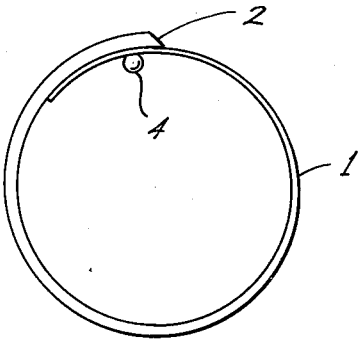
Fig. 4

DISPOSABLE HAIR ROLLER

BACKGROUND OF THE INVENTION

The applicants are the owners of U.S. Pats. No. 3,791,391 and No. 3,723,219 on Hair Rollers and on a hair roller making machine. The difficulty encountered with the rollers so made was that because of the cylindrical shape, they were bulky and difficult to ship. It was discovered that if the roller could be formed in a flat sheet, and rolled into the desired size of cylinder by the user, the shipping cost would be greatly reduced, and it therefore is an object of this invention to provide a disposable roller initially formed in flat sheets, and having means for maintaining said rollers in the desired size, cylindrically, when in the hands of the user.

SUMMARY OF THE INVENTION

A disposable hair roller, formed from flat sheets of pliable material having buttons and button receiving openings positioned in rows for selective receipt of the buttons when the roller is rolled into the desired diameter, said sheets having longitudinal perforations between each roller so that the rollers may be broken off for individual use and the cross sectional thickness of the sheets being tapered from the button end to the opposite end to facilitate easy rolling, and the material being inexpensive so that it may be disposed of after one time use, if desired.

BRIEF DESCRIPTION OF THE DRAWINGS

FIG. 1 is an isometric view of the sheet in flat form.

FIG. 2 is an end view of a rolled cylinder, in the smallest diameter.

FIG. 3 is an end view of a rolled cylinder in the medium diameter, and

FIG. 4 is an end view of a rolled cylinder in a larger diameter, by extending the length of flat material, as shown in dotted lines in FIG. 1.

DESCRIPTION OF THE PREFERRED EMBODIMENT

In the drawings, the numeral 1 designates a sheet of suitable material, such as polyurethane, or polyurethane coated paper, formed with one end being approximately twice as thick as the other end, the thickest end

2 having a plurality of buttons as 3, 3 integral with the sheet of material and protruding from the surface thereof, the ends of the buttons 3 being enlarged as 4, and the shanks being reduced in diameter, so that as the ends 4 pass through the selected openings 5, 5 and maintain the sheet in cylindrical position during use, they may be removed from the openings selected, after their first use, and moved to another row for a different diameter, if desired.

The openings 5 are in series, graduated to provide rollers of various diameters, and the sheet may bear the indicia indicating the row of openings for the various diameters, such as 1 in., 1½ in. etc.

The cylinders are formed by dies, stamps or molds which produce the sheets of the desired size, with the buttons on one end and the openings at the graduated positions, and with perforations longitudinally of the sheet for separation of the individual rollers. While in flat form, the sheets may be readily shipped or stored. When the user desires the rollers for hair treatment, the sheet is rolled into a cylinder, with the thin end 7 turned inside of the cylinder being formed, and the buttons 3 also being inside of the cylinder so formed. When the desired diameter has been acquired, the buttons 3 are inserted in the selected openings 5, and the individual rollers broken off at the perforated lines, and the rollers are ready for use. When the hair is removed from the rollers, they may be disposed of, or, if desired, they may be reused, so long as the buttons will remain seated in the openings.

What we claim is:

1. In a hair roller, a sheet of pliable material, the thickness of said sheet being gradually reduced longitudinally, buttons integral with the pliable material projecting laterally from a point adjacent one end, rows of button receiving openings spaced in vertical alignment in said material, each row being adapted to selectively receive said buttons and maintain said material in a cylindrical shape.

2. The device defined in claim 1 wherein said rows of openings are gradually spaced to form a selection of diameters into which the cylinders will be formed.

3. The device defined in claim 1 wherein said sheet is elongated to provide a plurality of rollers and is severable along a longitudinal line between each roller.

* * * * *